US005398900A

United States Patent [19]

Schober

[11] Patent Number: 5,398,900

[45] Date of Patent: Mar. 21, 1995

[54] MAGNETIC CURTAIN SUPPORT APPARATUS

[76] Inventor: Connie G. Schober, 5429 E. Cty. J., Clinton, Wis. 53525

[21] Appl. No.: 130,800

[22] Filed: Oct. 4, 1993

[51] Int. Cl.[6] ..... A47H 1/14

[52] U.S. Cl. ..... 248/251; 248/206.5; 248/263

[58] Field of Search ..... 248/263, 206.5, 261, 248/262, 251; 211/105.3; 160/84.1 R, 372, 330

[56] References Cited

U.S. PATENT DOCUMENTS

| | | | |
|---|---|---|---|
| 731,410 | 6/1903 | Shevill | 160/330 |
| 2,433,527 | 12/1947 | Mohr | 160/330 X |
| 2,458,643 | 1/1949 | Riley | 248/263 |
| 2,547,893 | 4/1951 | Stutz | 248/263 |
| 2,661,923 | 12/1953 | Meiners | 248/263 |
| 3,023,909 | 3/1962 | Martens | 211/105.3 |
| 3,160,384 | 12/1964 | Cirese | 248/206.5 X |
| 4,298,103 | 10/1988 | Rose . | |
| 4,569,462 | 2/1986 | Belokin | 248/206.5 X |
| 4,586,616 | 5/1986 | Cooper . | |
| 4,703,575 | 11/1987 | Diamond . | |

*Primary Examiner*—J. Franklin Foss
*Attorney, Agent, or Firm*—E. Michael Combs

[57] ABSTRACT

Spaced curtain supports of a mirror image configuration are arranged for magnetic adherence to a ferrous metallic wall surface, wherein each support includes a projecting flange arranged to accommodate curtain rods of selective rigid or telescoping construction.

3 Claims, 4 Drawing Sheets

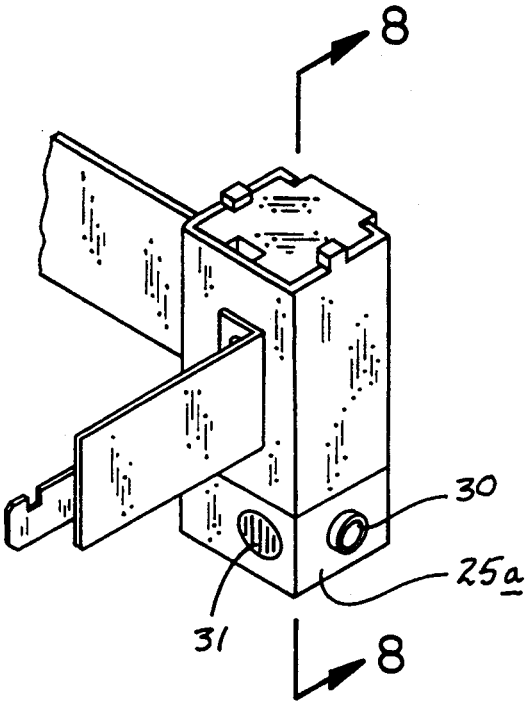
FIG. 7
FIG. 8
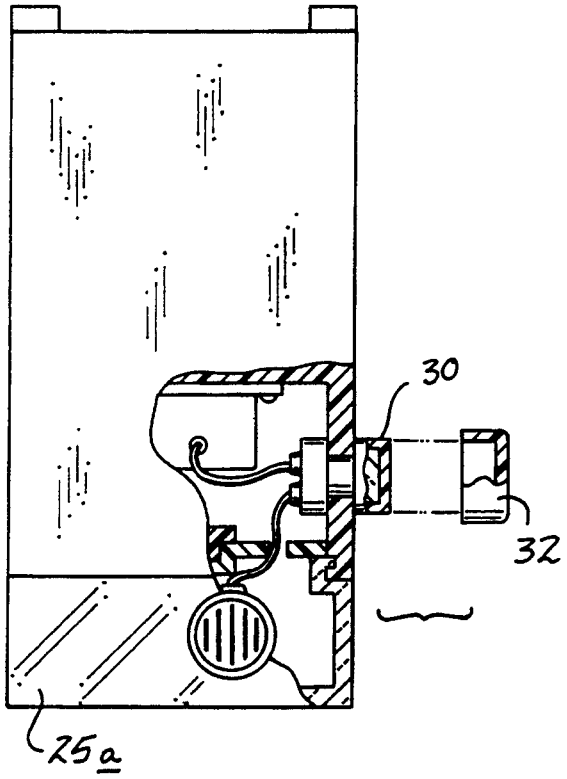

MAGNETIC CURTAIN SUPPORT APPARATUS

BACKGROUND OF THE INVENTION

1. Field of the Invention

The field of invention relates to curtain support apparatus, and more particularly pertains to a new and improved magnetic curtain support apparatus wherein the same is directed for magnetic adherence to a metallic support wall.

2. Description of the Prior Art

Curtain rod support apparatus is indicated in the prior art such as in U.S. Design patent No. 298,103. Magnetic support sign structure and utensil support bars are indicated in the U.S. Pat. Nos. 4,703,575 and 4,586,616 respectively.

The instant invention attempts to overcome deficiencies of the prior art by providing for a magnetic support arranged for ease of mounting of curtain rod structure therebetween and in this respect, the present invention substantially fulfills this need.

SUMMARY OF THE INVENTION

In view of the foregoing disadvantages inherent in the known types of curtain support apparatus now present in the prior art, the present invention provides a magnetic curtain support apparatus wherein the same is directed for the magnetic adherence to a support wall. As such, the general purpose of the present invention, which will be described subsequently in greater detail, is to provide a new and improved magnetic curtain support apparatus which has all the advantages of the prior art magnetic curtain support apparatus and none of the disadvantages.

To attain this, the present invention provides spaced curtain supports of a mirror image configuration arranged for magnetic adherence to a ferrous metallic wall surface, wherein each support includes a projecting flange arranged to accommodate curtain rods of selective rigid or telescoping construction.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved magnetic curtain support apparatus which has all the advantages of the prior art magnetic curtain support apparatus and none of the disadvantages.

It is another object of the present invention to provide a new and improved magnetic curtain support apparatus which may be easily and efficiently manufactured and marketed.

It is a further object of the present invention to provide a new and improved magnetic curtain support apparatus which is of a durable and reliable construction.

An even further object of the present invention is to provide a new and improved magnetic curtain support apparatus which is susceptible of a low cost of manufacture with regard to both materials and labor, and which accordingly is then susceptible of low prices of sale to the consuming public, thereby making such magnetic curtain support apparatus economically available to the buying public.

Still yet another object of the present invention is to provide a new and improved magnetic curtain support apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 7 is an isometric illustration of a further modified curtain support member.

FIG. 8 is an orthographic view, partially in section, taken along the lines 8—8 of FIG. 7 in the direction indicated by the arrows.

DESCRIPTION OF THE PREFERRED EMBODIMENT

Figure 1:
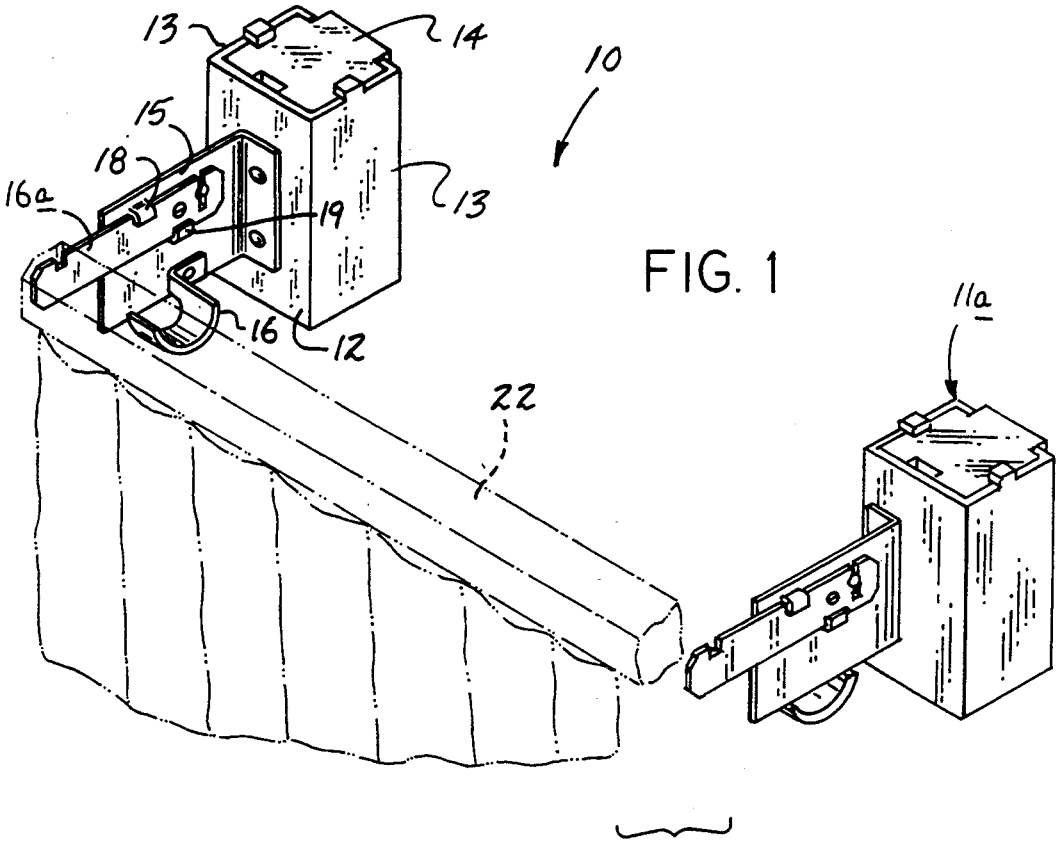
FIG. 1 is an isometric illustration of the invention.
Figure 2:
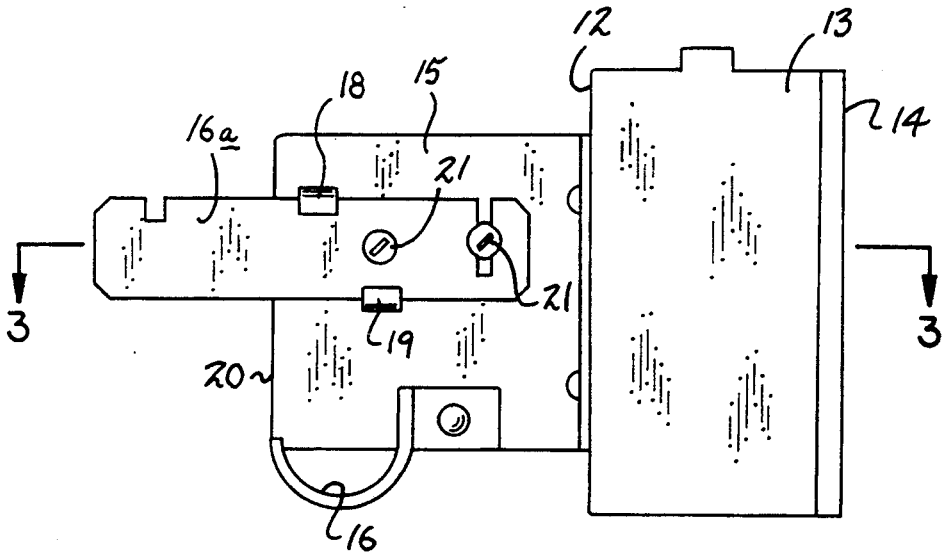
FIG. 2 is an orthographic side view of an individual curtain support member.
Figure 3:
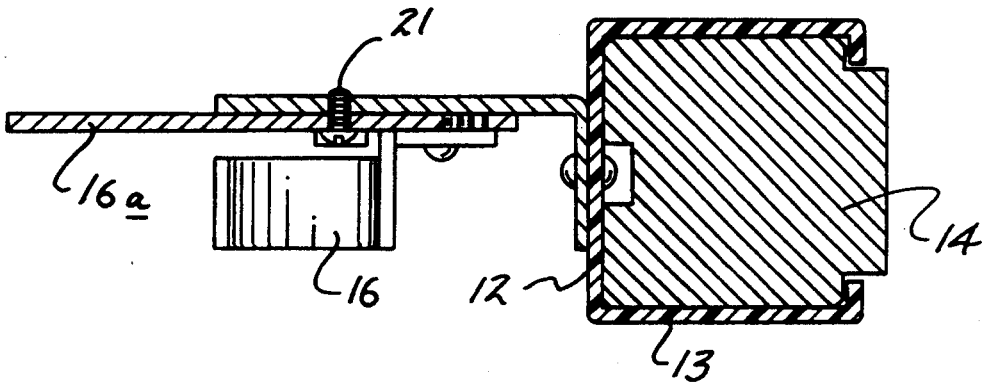
FIG. 3 is an orthographic view, taken along the lines 3—3 of FIG. 2 in the direction indicated by the arrows.
Figure 4:
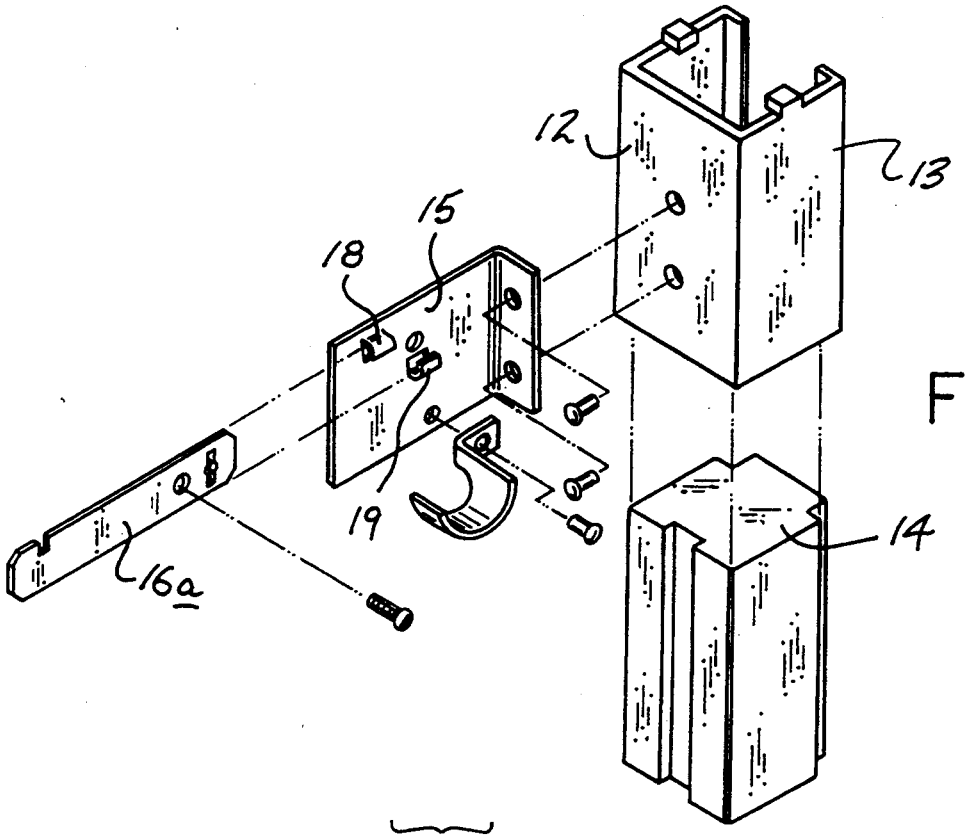
FIG. 4 is an isometric exploded illustration of the curtain support member.

With reference now to the drawings, and in particular to FIGS. 1 to 8 thereof, a new and improved magnetic curtain support apparatus embodying the principles and concepts of the present invention and generally designated by the reference numeral 10 will be described.

More specifically, the magnetic curtain support apparatus 10 of the instant invention essentially comprises a first support 11 arranged in a coextensive and spaced relationship relative to a second support 11*a*, with the first and second supports 11 and 11*a* respectively of a mirror image relationship relative to one another, as indicated in FIG. 1. To this end, only the first support 11 is described herein below, but it is understood that mirror image components of identical construction are mounted to and are part of the second support 11*a*.

Each support includes a housing front wall 12, with housing side walls 13 containing a ferromagnetic core 14 projecting through the housing rear wall. A first support flange 15 extends orthogonally from the housing front wall 12 projecting therebeyond, having a first flange forward end 20 spaced from the front wall 12. An arcuate cradle 16 is mounted to a lowermost edge of the first support flange 15, wherein the facing arcuate cradle 16 of each of the first and second supports 11 and 11*a* are arranged to selectively mount a second support rod therebetween (not shown), wherein a curtain rod 22 either of a unitary or telescoping construction is mounted between the second support flanges 16*a*, that in turn are mounted in a parallel contiguous relationship relative to the first support flange 15 projecting beyond the first flange forward end 20. Offset first and second L-shaped flanges 18 and 19 are fixedly mounted to the first support flange 15 securing the second support flange 16*a* therebetween, with the first L-shaped flange 18 spaced in adjacency relative to the first flange forward edge 20 and the second L-shaped support flange 19 spaced between the first L-shaped support flange and the housing front wall 12, with at least one fastener 21 mounted between the first L-shaped support flange 18 and the housing front wall 12 for securement of the second support flange 16*a* to the first support flange 15. In this manner, mounting of the magnetic cores 14 to a metallic vertical support surface (not shown) is readily accomplished in the mounting of a curtain assembly to a ferrometallic support surface.

Figure 5:
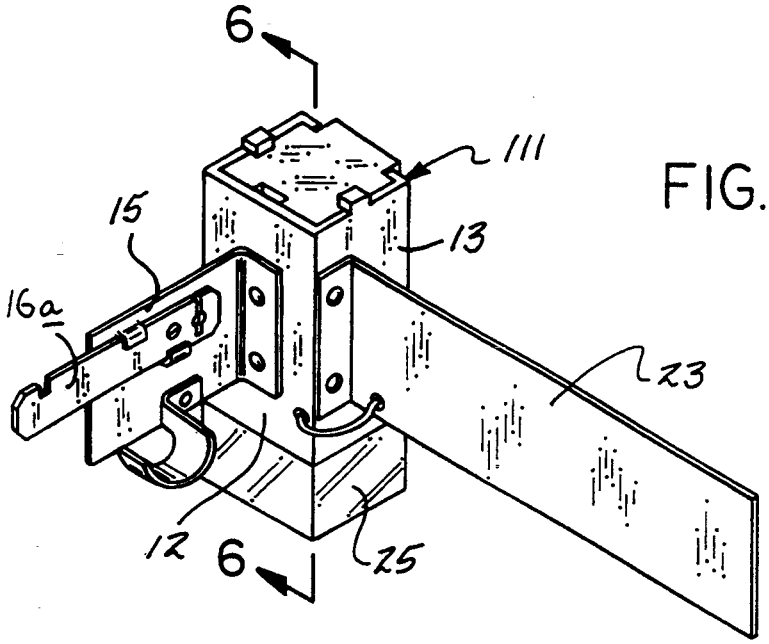
FIG. 5 is an isometric illustration of a modified curtain support, member.
Figure 6:
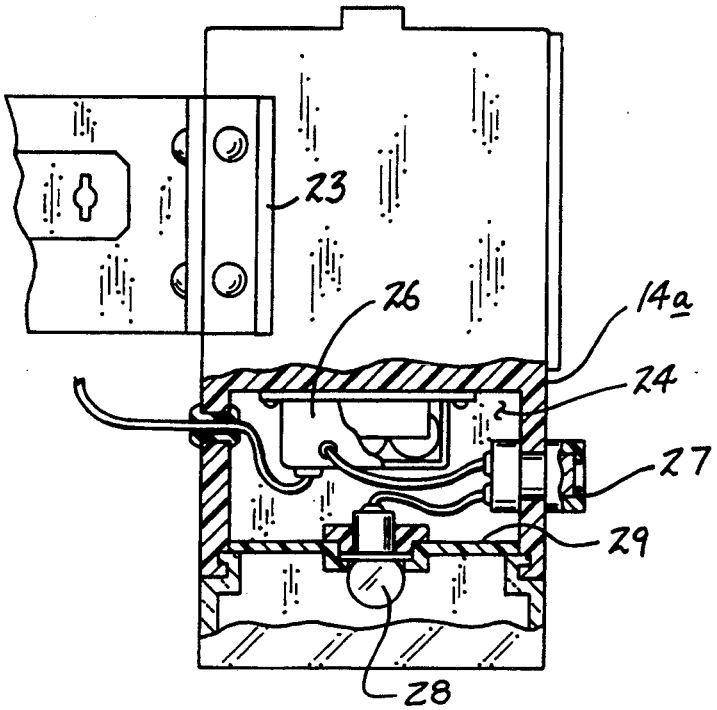
FIG. 6 is an orthographic view, partially in section, taken along the lines 6—6 of FIG. 5 in the direction indicated by the arrows.

The FIGS. 5 and 6 indicates the use of a modified first support 111, having mounted at a lower periphery of the front and side walls 12 and 13 respectively, a transparent lens 25. Reference to FIG. 6 indicates a core housing cavity 24 positioned within the magnetic core 14*a*, having a battery charger and battery pack 26 in operative communication with the solar panel 23 to provide for charging of the batteries within the battery pack, with a photo-cell switch 27 in electrical communication between the batteries of the battery pack and an illumination bulb 28 extending through a cavity floor 29 of the housing cavity 24. The illumination bulb 28 is positioned within the transparent lens 25 and operative upon the photo-cell switch 27 detecting an absence of available light to provide for enhanced illumination relative to the curtain structure for enhanced appealing effect in use of the curtain structure.

The use of a modified lens 25*a*, as indicated in the FIGS. 7 and 8, to further employ in operative communication with the battery pack 26 a motion sensor 30 projecting through the modified lens 25*a* arranged to receive a resilient covering cap 32 thereover preventing actuation of an associated audible alarm 31. Should the audible alarm be desired in addition to the illumination structure, the cap 32 is merely removed, whereupon detection of motion within an available room and the like is provided. This is particularly desirable when the curtains are positioned over a window and the motion sensor will thusly detect unauthorized entrance through such window opening as is intended with use of covering curtains as contemplated by the invention.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A magnetic curtain support apparatus, comprising, a first support member in a spaced, parallel, and coextensive relationship relative to a second support member, with each support member including a housing front wall and spaced housing side walls, with a ferromagnetic core extending from each housing between the side walls, with the ferromagnetic core coextensive with the front wall and the side walls, and the front wall having a first support flange extending from the front wall, with the first support flange including a second support flange mounted to the first support flange extending therefrom, the first support flange includes spaced first and second flanges fixedly mounted to the first support flange securing the second support flange between the first and second flanges, with the first flange positioned in adjacency to a first support flange forward edge, with the second support flange oriented between the first support flange and the front wall, with a fastener directed through the second support flange into the first support flange between the first flange and the front wall.

2. An apparatus as set forth in claim 1 including a solar panel extending from one of said housing side walls, and the housing side walls and the housing front wall further includes a transparent lens mounted to a lower periphery of the front wall and the side walls, with the ferromagnetic core having a core cavity, and a cavity floor mounted within the ferromagnetic core between the cavity and the transparent lens, with a battery charger and battery pack in operative association with the solar panel mounted within the cavity, and a photo-cell switch projecting from the cavity, and an illumination bulb in operative communication with the photo-cell switch, with the illumination bulb directed through the cavity floor positioned projecting below the housing front wall and the housing side wall surrounded by said transparent lens.

3. An apparatus as set forth in claim 2 further including a motion sensor projecting through the transparent lens having a resilient removable cap mounted thereon, with the motion sensor in operative communication with the battery charger and battery pack, and in operative communication with an audible alarm, whereupon closing of the motion sensor effects actuation of the audible alarm upon removal of the cap relative to the motion sensor.

* * * * *